US007610944B2

(12) United States Patent
Reiter

(10) Patent No.: US 7,610,944 B2
(45) Date of Patent: Nov. 3, 2009

(54) MAGNETIC HANDLE SYSTEM FOR BAGS

(75) Inventor: Howard J. Reiter, Orange, CT (US)

(73) Assignee: Lodestone Fasteners LLC, Woodbridge, CT (US)

( * ) Notice: Subject to any disclaimer, the term of this patent is extended or adjusted under 35 U.S.C. 154(b) by 687 days.

(21) Appl. No.: 10/921,454

(22) Filed: Aug. 19, 2004

(65) Prior Publication Data

US 2006/0037682 A1 Feb. 23, 2006

(51) Int. Cl.
*A45C 13/26* (2006.01)

(52) U.S. Cl. ..... 150/107; 224/183

(58) Field of Classification Search ..... 150/107; 224/183

See application file for complete search history.

(56) References Cited

U.S. PATENT DOCUMENTS 4,763,763 A * 8/1988 Sadow ..... 190/115
6,052,828 A * 4/2000 Widdemer ..... 2/161.2
2003/0145927 A1* 8/2003 Lee ..... 150/107

* cited by examiner

*Primary Examiner*—Tri M Mai
(74) *Attorney, Agent, or Firm*—Cooper & Dunham LLP

(57) ABSTRACT

A magnetic handle system for use in briefcases, luggage, handbags or the like, having a first handle and a second handle, each including a magnetic member, whereby moving the first handle into proximity of the second handle creates a magnetic force which releasably connects the first and second handles.

13 Claims, 3 Drawing Sheets

MAGNETIC HANDLE SYSTEM FOR BAGS

FIELD OF THE INVENTION

The instant invention relates to a magnetic handle system for use in briefcases, handbags, luggage or the like, having a first handle and a second handle, each including a magnetic handle, whereby moving the first handle into proximity of the second handle creates a magnetic force which releasably connects the first and second handles.

BACKGROUND OF THE INVENTION

Many attaché cases, computer cases, briefcases, duffel bags, and luggage are made with a pair of carrying handles surrounding the main cargo compartment of the case. Handles constructed of stiff materials are attached to the case by a piece of hardware, such as a metal hinge. Alternatively, handles made of flexible material are sewn into the sidewall or gusset of the case. In either application, the handles will fall down when the grip is released and must be folded up and held together again each time the case is to be picked up. This process is inconvenient and time-consuming. Additionally, the owner must often bend over to fetch the folded handles, thus risking bodily injury.

Prior art has addressed this issue by using a handle wrap which is a flap sewn into one of the two handles. The flap wraps around both handles and contains a means for securing the flap to itself, such as mechanical snap fasteners or a hook and loop system. Both of these systems are poor solutions because they are bulky and the user must take time to engage the fasteners when opening or closing the handles. This often necessitates the use of both hands.

Magnets have been used to connect two pieces of material. For example, U.S. Pat. No. 5,722,126, issued to Howard J. Reiter, entitled "Magnetic Snap Fasteners", shows a magnetic snap fastener for releasably connecting two pieces of material. However, this system has not been used for bag handles.

In addition magnets have been used in bag closures and latches. For example U.S. Pat. No. 6,070,628, issued to Ancela Natasi, entitled "Handbag With Magnetic Closure", shows a handbag with a magnetic flap closure arrangement that both closes and latches the top of the handbag. This system also has not been used for bag handles.

Heretofore, it has not been known to have a handle system for use on a bag which can releasably connect the bag handles. Therefore, there is a need for a handle system that is not bulky and can be hidden inside the bag handles.

SUMMARY OF THE INVENTION

The present invention is for a system to magnetically fasten or hold the handles together which allows the handles to hold together easily and instantly while also providing the user with faster and more immediate access to the contents of the case. The system has the advantage over the prior art in that it is not bulky and allows the bag to be opened and closed easily without the use of both hands.

It is therefore an object of the present invention to provide a magnetic handle system for use on a bag which can releasably connect the handles on a bag.

It is a further object of the present invention to provide a suitable handle system for use on a bag such as a handbag, a briefcase, a suitcase, a travel bag, a gym bag, a golf bag, a bowling bag, a tote bag, and a case.

To that end, a magnetic handle system for use on a bag is disclosed comprising (a) a first handle, having a first magnet and a first non-magnetic over-wrap; (b) a second handle having a second magnet and a second non-magnetic over-wrap; (c) whereby placing the first handle into proximity of the second handle creates a magnetic force which releasably connects the first and second handles. The first and second handles can be secured to a bag. The first and second non-magnetic over-wrap can be plastic, leather or fabric. The first and second magnets can be manufactured from any permanent magnetic material such as ceramic ferrite, samarium-cobalt, or neodymium-iron-boron.

The term "magnet" is meant to be broad enough to include a material that retains its magnetism after removal of the magnetizing force.

The term "non-magnetic material" is meant to be broad enough to include a material that does not respond to a magnetic field. Non-magnetic materials include without limitation rubber, wood, leather, fabric, and some plastics.

The term "over-wrap" is meant to be broad enough to include the outside layer of the handle system, inside which the magnetic members of the present invention are located. The over-wrap can be composed of any non-magnetic material.

The term "ferromagnetic material" is meant to be broad enough to include a material that responds strongly to a magnetic field. Ferromagnetic materials include without limitation iron, nickel, cobalt and steel.

BRIEF DESCRIPTION OF THE FIGURES

The features and advantages of the invention will become apparent upon review of the following detailed description of the preferred embodiment, taken in conjunction with the following drawings, in which.

DETAILED DESCRIPTION OF THE INVENTION

The present invention relates to a magnetic handle system for bags, comprising (a) a first handle and (b) a second handle, (c) whereby moving the first handle into proximity of the second handle creates a magnetic force which releasably connects the first and second handles. The first and second handles can be secured to a bag at the respective sides or gussets.

Figure 1:
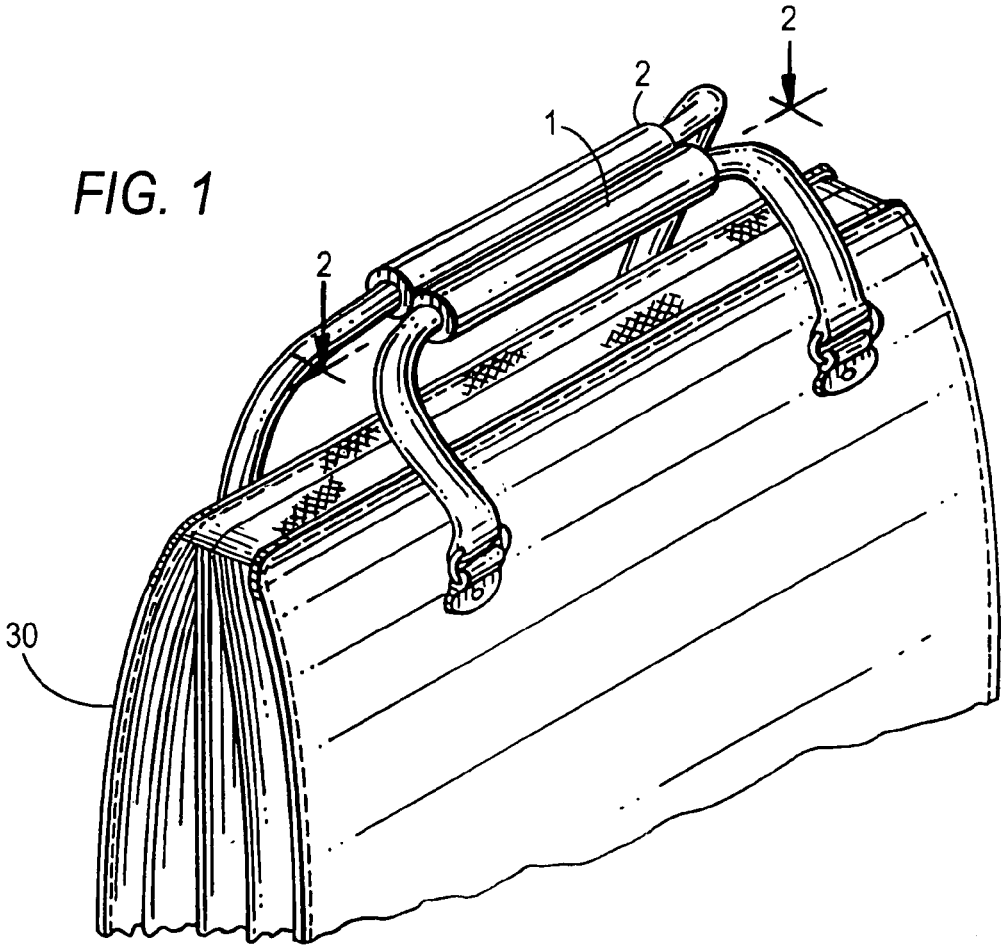
FIG. 1 is a perspective view of a bag with the magnetic handle system of the invention.

FIG. 1 shows a preferred embodiment of the present invention. As shown in FIG. 1, a first handle (1) and a second handle (2) are attached exterior surfaces of a bag (30).

Figure 2:
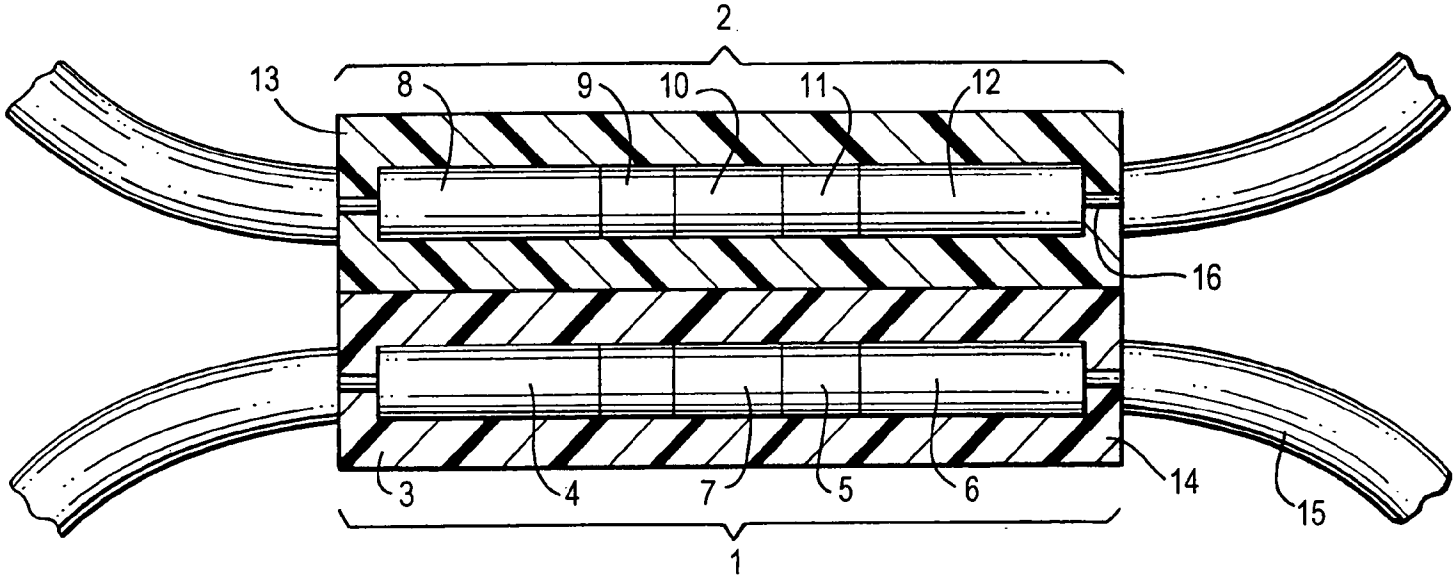
FIG. 2 is a cross-sectional view of the preferred embodiment of the magnetic handle system shown in FIG. 1.

Referring to FIG. 2, the first handle (1) and the second handle (2) are shown. The first handle (1) includes two tubes (3) and (6); two washers (4) and (5); and a magnet (7). The second handle (2) includes two tubes (8) and (12); two washers (9) and (11); and a magnet (10). The first handle (1) and the second handle (2) are each covered by over-wraps (14) and (13), respectively.

Figure 3:
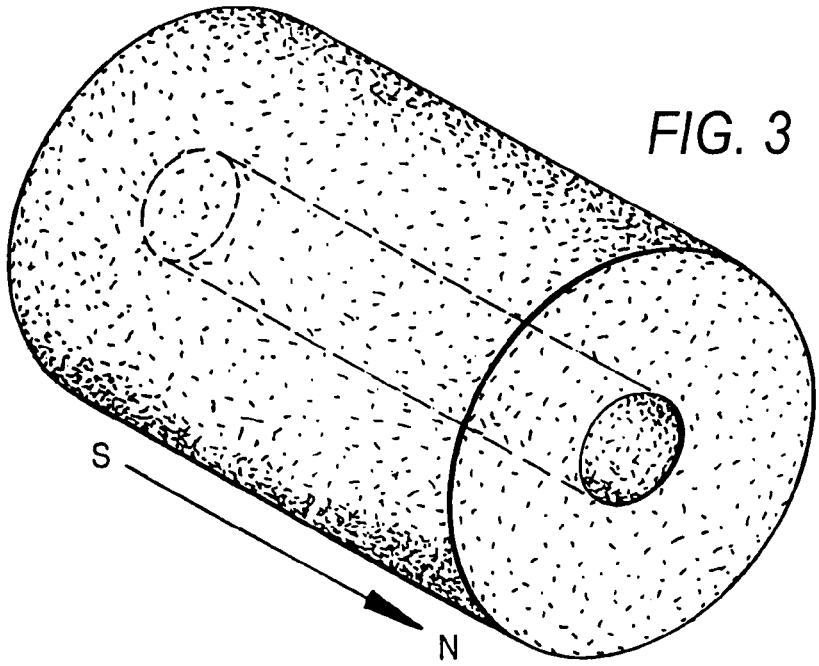
FIG. 3 is a perspective view of a magnet magnetized across its faces.
Figure 4:
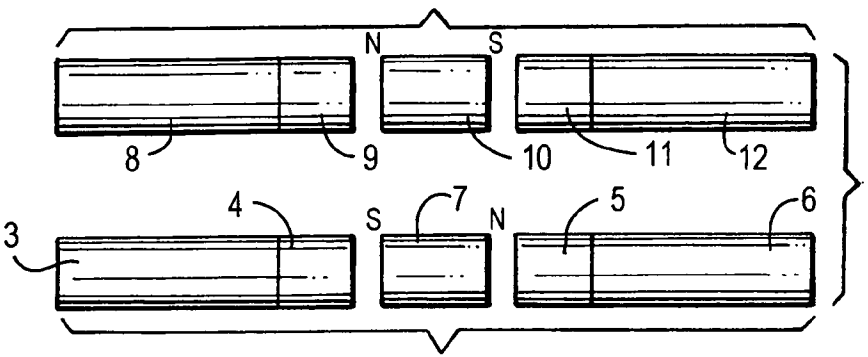
FIG. 4 is a cross-sectional view of the preferred embodiment showing the orientation of the magnetic fields.

The magnets (7) and (10) are cylindrical in shape. The magnets (7) and (10) can be of any length suitable for use in a handle. In the preferred embodiment, the length is between 0.1 and 0.5 cm and preferably about 0.4 cm. The magnets (7) and (10) can have an outside of any diameter suitable for use in a handle. In the preferred embodiment, the length is between 1 and 3 cm. The magnets may be made of neodymium-iron-boron, ceramic ferrite, samarium-cobalt or other suitable magnetic material. The magnets are magnetized across their faces as shown in FIG. 3. The magnets are oriented on the handles so that their north and south poles are counter-opposed as shown in FIG. 4.

The tubes (3), (6), (8), and (12) also are cylindrical in shape. They can be of any length suitable for use in a handle. In the preferred embodiment, the length is between 1.5 and 5 cm and preferably about 2.6 cm. The tubes (3), (6), (8), and (12) can have an outside diameter of any diameter suitable for use in a handle, and preferably about 1 to 3 cm. Tubes made of plastic, rubber, wood or other non-magnetic material can be used.

The washers (4), (5), (9), and (11) also are cylindrical in shape. They can be of any length suitable for use in a handle. In the preferred embodiment, the length is about 0.1 to 0.5 cm and preferably about 0.4 cm. The washers (4), (5), (9), and (11) can have any outside diameter suitable for use in a handle, and preferably about 1 to cm. Steel washers or those of other ferromagnetic materials can be used.

The rubber tubes (3), (6), (8), and (12), the steel washers (4), (5), (9), and (11), and the neodymium-iron-boron magnets (7) and (10) preferably have the same outside diameter. In the preferred embodiment, the outside diameter is about 1.2 cm.

The rubber tubes (3), (6), (8), and (12), the steel washers (4), (5), (9), and (11), and the neodymium-iron-boron magnets (7) and (10) each have a hole substantially in the center thereof. This hole facilitates the manufacture of the handle by allowing the components to be threaded together on a string, wire or the like. In the preferred embodiment, the components are threaded together by strings (15) and (16) which can be of any diameter suitable for threading the components. In the preferred embodiment, the strings are about 0.4 cm in diameter. The inside diameter of the hole defined by the rubber tubes (3), (6), (8), and (12), the steel washers (4), (5), (9), and (11), and the neodymium-iron-boron magnets (7) and (10), can be any diameter suitable for threading with a string, wire or the like. In the preferred embodiment, the diameter of the hole is about 0.7 cm.

Figure 5:
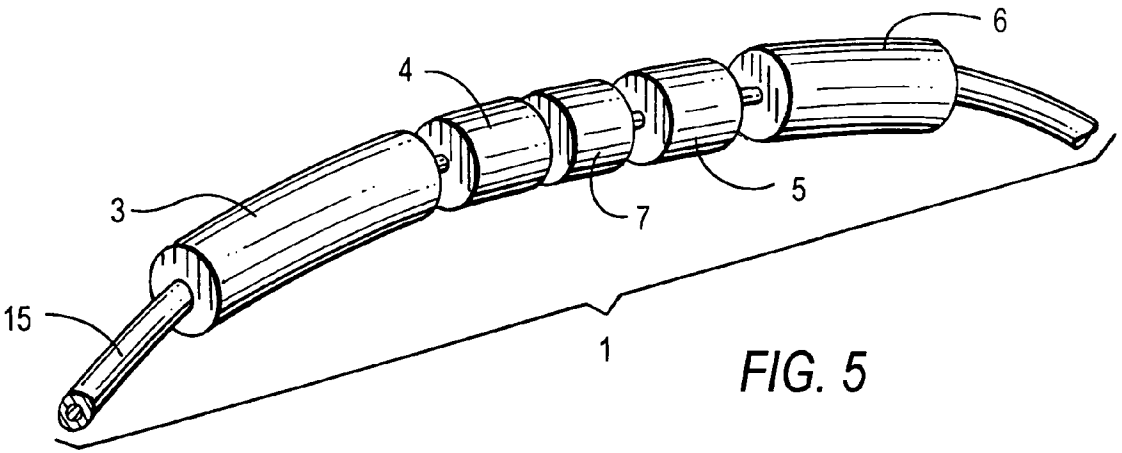
FIG. 5 is a perspective view of a handle of the preferred embodiment of the magnetic handle system.

FIG. 5 shows a perspective view of one of the handles of the preferred embodiment of the magnetic handle system. The handle is shown without an over-wrap.

Figure 6:
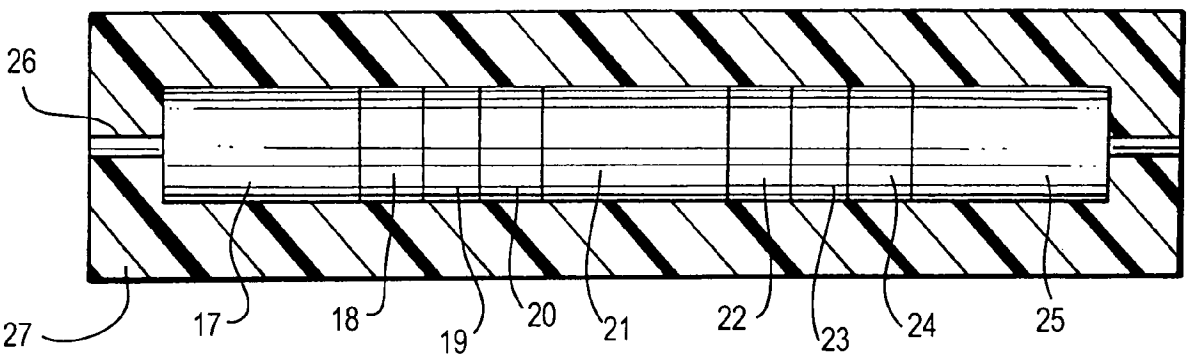
FIG. 6 is a cross-sectional view of the handle of another embodiment of the magnetic handle system.

FIG. 6 shows a handle of another embodiment of the magnetic handle system. In this embodiment, additional tubes (17), (21) and (25); washers (18), (20), (22) and (24); and magnets (19) and (23) are used. These are arranged similarly to that shown in FIGS. 2, 4, and 5. These components are covered by a leather over-wrap (27) and threaded together by a string (26). FIG. 6 illustrates the main components of the magnetic handle system repeated, in sequence, multiple times, thereby allowing the magnetic handle system to be manufactured of any length.

The preferred and other embodiments described above are illustrative of the invention, which is not limited to the embodiments described. Various changes and modification may be made in the invention by one skilled in the art without departing from the spirit or scope of the invention.

What is claimed is:

1. A magnetic handle system for use on a bag, comprising:
(a) a first handle, having
a first magnet;
a first pair of ferromagnetic pole pieces; and
a first non-magnetic over-wrap;
(b) a second handle, having
a second magnet;
a second pair of ferromagnetic pole pieces; and
a second non-magnetic over-wrap;
(c) whereby the first and second magnets and the first and second pair of ferromagnetic pole pieces are cylindrical and annular, and both magnets and both pairs of ferromagnetic pole pieces are configured such that moving the first handle into proximity of the second handle creates a magnetic force which releasably connects the first and second handles.

2. The magnetic handle system of claim 1 wherein the first and second handles are secured to a bag.

3. The magnetic handle system of claim 2 wherein the bag is selected from the group consisting of a handbag, a briefcase, a suitcase, a travel bag, a gym bag, a golf bag, a bowling bag, a tote bag and a case.

4. The magnetic handle system of claim 1 wherein the magnet is any permanent magnetic material.

5. The method of claim 4, wherein the permanent magnetic material is selected from the group consisting of ceramic ferrite, samarium-cobalt, and neodymium-iron-boron.

6. The magnetic handle system of claim 1 wherein the over-wrap is of a material selected from the group consisting of plastic, leather and fabric.

7. The magnetic handle system of claim 1 whereby the first and second magnets have North and South poles which project magnetic flux out of the magnets in an axial direction through the ferromagnetic pole piece at each pole which bends the flux field in a radial direction around the handle whereby moving the first handle into proximity of the second handle at any orientation creates a magnetic force which releasably connects the first and second handles.

8. A bag including a magnetic handle system comprising:
(a) a first handle, having
a first magnet;
a first pair of ferromagnetic pole pieces; and
a first non-magnetic over-wrap;
(b) a second handle, having
a second magnet;
a second pair of ferromagnetic pole pieces; and
a second non-magnetic over-wrap;
(c) whereby the first and second magnets and the first and second pair of ferromagnetic pole pieces are cylindrical and annular, and both magnets and both pairs of ferromagnetic pole pieces are configured such that moving the first handle into proximity of the second handle creates a magnetic force which releasably connects the first and second handles and thereby closes the bag.

9. A bag including a magnetic handle system of claim 8 whereby the first and second magnets have North and South poles which project magnetic flux out of the magnets in an axial direction through the ferromagnetic pole piece at each pole which bends the flux field in a radial direction around the handle whereby moving the first handle into proximity of the second handle at any orientation creates a magnetic force which releasably connects the first and second handles.

10. A magnetic handle system for use on a bag, comprising:
(a) a first handle having a first magnet, a first washer, a second washer, a first tube, a second tube each having a center hole, and a first string passing through the respective holes to hold the first handle together, a first non-magnetic over-wrap, and (b) a second handle having a second magnet, a third washer, a fourth washer, a third tube, a fourth tube each having a center hole, and a second string passing through the respective holes to hold the second handle together and a second non-magnetic over-wrap;

whereby the first and second magnets are cylindrical, annular magnets, and both magnets are configured such that moving the first handle into proximity of the second handle creates a magnetic force which releasably connects the first and second handles.

11. A bag including a magnetic handle system comprising:

(a) a first handle having a first magnet, a first washer, a second washer, a first tube, a second tube each having a center hole, and a first string passing through the respective holes to hold the first handle together, a first non-magnetic over-wrap, and (b) a second handle having a second magnet, a third washer, a fourth washer, a third tube, a fourth tube each having a center hole, and a second string passing through the respective holes to hold the second handle together and a second non-magnetic over-wrap;

whereby the first and second magnets are cylindrical, annular magnets, and both magnets are configured such that moving the first handle into proximity of the second handle creates a magnetic force which releasably connects the first and second handles.

12. A magnetic handle system for use on a bag, comprising (a) a first handle having a first magnet, a third magnet, a first washer, a second washer, a third washer, a fourth washer, a first tube, a second tube, a third tube each having a center hole, and a first string passing through the respective holes to hold the first handle together, a first non-magnetic over-wrap and (b) a second handle having a second magnet, a fourth magnet, a fifth washer, a sixth washer, a seventh washer, an eighth washer, a fourth tube, a fifth tube, a sixth tube each having a center hold, and a second string passing through the respective holes to hold the second handle together and a second non-magnetic over-wrap;

whereby the first, second, third, and fourth magnets are cylindrical, annular magnets, and the magnets are configured such that moving the first handle into proximity of the second handle creates a magnetic force which releasably connects the first and second handles.

13. A bag including a magnetic handle system comprising:

(a) a first handle having a first magnet, a third magnet, a first washer, a second washer, a third washer, a fourth washer, a first tube, a second tube, a third tube each having a center hole, and a first string passing through the respective holes to hold the first handle together, a first non-magnetic over-wrap; and (b) a second handle having a second magnet, a fourth magnet, a fifth washer, a sixth washer, a seventh washer, an eighth washer, a fourth tube, a fifth tube, a sixth tube each having a center hold, and a second string passing through the respective holes to hold the second handle together and a second non-magnetic over-wrap;

whereby the first, second, third, and fourth magnets are cylindrical, annular magnets, and the magnets are configured such that moving the first handle into proximity of the second handle creates a magnetic force which releasably connects the first and second handles.

* * * * *